US006979815B2

(12) United States Patent
Duhamel

(10) Patent No.: US 6,979,815 B2
(45) Date of Patent: Dec. 27, 2005

(54) FOLDING APPARATUS OF A WEB-FED PRINTING PRESS INCLUDING A CONVEYOR BELT MONITORING DEVICE

(75) Inventor: Claude Duhamel, Mogneville (FR)

(73) Assignee: Goss International Montataire, S.A., Montataire (FR)

( * ) Notice: Subject to any disclaimer, the term of this patent is extended or adjusted under 35 U.S.C. 154(b) by 213 days.

(21) Appl. No.: 10/366,245

(22) Filed: Feb. 13, 2003

(65) Prior Publication Data

US 2003/0160156 A1 Aug. 28, 2003

(30) Foreign Application Priority Data

Feb. 23, 2002 (DE) ..... 102 07 869

(51) Int. Cl.[7] ..... B65G 43/00; G01N 21/86; G01V 8/00

(52) U.S. Cl. ..... 250/223 R; 250/224; 250/559.42; 250/559.43; 198/810.02; 356/237.2; 356/430

(58) Field of Search ..... 250/223 R, 224, 250/559.42, 559.43, 559.45, 559.46; 198/341.03, 198/341.07, 460.1, 464.2, 502.1–502.4, 810.01; 356/237.1, 237.2, 430

(56) References Cited

U.S. PATENT DOCUMENTS

| | | | | |
|---|---|---|---|---|
| 4,464,654 | A * | 8/1984 | Klein | 198/810.02 |
| 4,587,414 | A | 5/1986 | Bohlander | 250/202 |
| 5,168,266 | A * | 12/1992 | Fukuda | 340/676 |
| 6,032,787 | A * | 3/2000 | Kellis | 198/810.02 |
| 6,440,049 | B1 | 8/2002 | Belanger et al. | 493/14 |
| 6,446,961 | B1 | 9/2002 | Foret et al. | 271/259 |
| 6,781,515 | B2 * | 8/2004 | Kuzik et al. | 340/676 |
| 2003/0116701 | A1 * | 6/2003 | Nickels et al. | 250/223 R |
| 2003/0168317 | A1 * | 9/2003 | Fromme et al. | 198/502.1 |

FOREIGN PATENT DOCUMENTS

| | | |
|---|---|---|
| DE | 4444264 | 4/1996 |
| DE | 19856373 | 8/1999 |
| EP | 1069062 | 1/2001 |

* cited by examiner

*Primary Examiner*—David Porta
*Assistant Examiner*—Davienne Monbleau
(74) *Attorney, Agent, or Firm*—Davidson, Davidson & Kappel, LLC

(57) ABSTRACT

A folding apparatus (30) having at least one conveyor belt (10) which is used to convey signatures (64) at least on a section of a path (66, 68) of the signatures (64) through the folding apparatus (30). The folding apparatus (30) features at least one monitoring device (12) with which the conveyor belt (10) is associated. The monitoring device (12) contains a detector (20) for radiation (22) scattered from at least a part (24) of the conveyor belt (10). The condition of the conveyor belt (10) can be determined and classified in an advantageous manner so that the machine operator can receive a signal for timely replacement so as to avoid an unexpected breakage of the conveyor belt (10).

15 Claims, 5 Drawing Sheets

FOLDING APPARATUS OF A WEB-FED PRINTING PRESS INCLUDING A CONVEYOR BELT MONITORING DEVICE

Priority to German Patent Application No. 102 07 869.6, filed Feb. 23, 2002 and hereby incorporated by reference herein, is claimed.

BACKGROUND INFORMATION

The present invention relates to a folding apparatus having at least one conveyor belt which is used to convey signatures at least on a section of a path of the signatures through the folding apparatus.

In a folding apparatus, sheets or copies that are cut off from a printing-material web are folded into signatures and delivered. For that purpose, typical folding apparatuses have a plurality of processing devices to produce folds, perforations, grooves, cuts, and the like. Folding apparatuses often have a number of paths along which the processing devices are arranged and the signatures are transported. Frequently, transport devices are designed as conveyor belts. Depending on the final printed product to be produced or the type of fold, it is possible to switch between the different paths. For simplicity, a cut-off sheet or a cut-off copy will be referred to herein as a signature.

Due to the complex sequence of operations carried out on the signature, folding apparatuses contain a plurality of error sources causing damage to the signatures or a loss of production. These error sources in particular also may arise when setting up the folding apparatus in a new configuration for a final printed product to be produced or a type of fold to be produced. Thus, in typical folding apparatuses of the prior art, provision is made for monitoring devices for the transport of the signatures along the different paths in order to detect paper jams and misdirection of paper.

For example, European Patent Application No. 1 069 062 A2 provides a paper travel monitoring device in a folding apparatus, the paper travel monitoring device being able to detect misdirected signatures and to turn off the folding apparatus. Arranged along the paths of the signatures through the folding apparatus are sensors which are evaluated on the basis of the signature progression. Preferably, the sensor system is composed of sensor pairs, that is, transmitters and receivers between which runs the path of the copies.

It has turned out that an important reason for a loss of production in the folding apparatus is the unexpected breakage of conveyor belts, which are subject to pronounced wear. Since in known methods heretofore monitoring devices concentrate on the paper travel per se, in particular for the adjustment of the folding apparatus, or detect paper jams or misdirection of paper after a problem has occurred, so far information on the condition of the conveyor belts in the folding apparatus is not provided to the machine control during set-up or while the production is in progress. Normal wear, the unexpected breaks and an unfortunate overstretching because of a paper jam or due to an emergency stop of the machine or even the disappearance of a conveyor belt because of the exceeding of its service life are only detected during a visual inspection of the folding apparatus by a machine operator, typically while the folding apparatus is at rest. Furthermore, a poor quality condition of the conveyor belts can result in damage to the signatures even prior to breakage.

SUMMARY OF THE INVENTION

An object of the present invention is to provide a folding apparatus which has lower downtimes due to unexpected breakage of conveyor belts.

According to the present invention, the intention is to obtain information on the quality condition of a conveyor belt preventively, that is, before an unexpected breakage occurs. To this end, a folding apparatus according to the present invention having at least one conveyor belt which is used to convey signatures at least on a section of a path of the signatures through the folding apparatus, features at least one monitoring device with which the conveyor belt is associated, the monitoring device containing a detector for radiation scattered from at least a part of the conveyor belt during at least a period of time.

The radiation can be electromagnetic radiation, in particular visible or infrared light, preferably laser light or ultrasound.

Using the monitoring device, it is possible to detect whether there is a high probability of imminent breakage of a conveyor belt. Thus, replacement can be accomplished before an unexpected breakage of a worn conveyor belt occurs, in particular when the quality condition of the conveyor belt is no longer good enough for error-free production. Thus, a folding apparatus according to the present invention has lower downtimes due to unexpected breakage of a conveyor belt than a folding apparatus without the monitoring device according to the present invention.

Thus, the monitoring device has at least two different functions: first to detect the presence of the conveyor belt and second to detect the quality state of the conveyor belt. In other words, besides the function of detecting breakage, it is also possible to obtain information on the wear of the conveyor belt so that a decision can be made as to whether replacement of the conveyor belt appears to be necessary. Replacing the conveyor belt in time reduces the risk of unexpected breakage.

According to the present invention, a method for monitoring at least one conveyor belt in a folding apparatus is carried out, including the following steps. Radiation is detected that is scattered from at least a part of the conveyor belt at least during a period of time. A signal is generated which is representative of the condition of the conveyor belt, in particular of the presence condition and/or of the quality condition. The signal is assigned to a condition class. For assessing the presence, at least two classes are required to discriminate presence and absence. The quality classes are subclasses of the presence class of being present. There can be a number of quality condition classes. Typically, two or three classes appear to be useful for quality assessment in order to distinguish adequate from inadequate quality, possibly with a third class of just adequate quality. The condition class assignment can be carried out in an evaluation unit or in a machine control according to predetermined criteria using the conveyor belt parameters.

In a particularly advantageous refinement of the method, the radiation is emitted on the conveyor belt at a grazing incidence. It can also be detected at a grazing incidence. The radiation also can be emitted above or below the conveyor belt, skewed to the direction of the conveyor belt. In this manner, it is possible to detect small deformations of the conveyor belt, such as the fraying thereof, or a detaching connection of two ends.

In an advantageous embodiment, the monitoring device of the folding apparatus includes a radiation emitter and a radiation detector. In other words, starting at a radiation source, the conveyor belt is exposed to a radiant flux and the scattered radiation is detected. The change or deviation of the scattered radiation (intensity, direction, or the like) is a measure for the deviation of the condition of the conveyor belt from a reference condition, for example, the condition of a quality that is rated as good. The change can be an increase or a decrease. The emitted radiation can, in particular, be directional.

To increase the contrast between the different conditions, the conveyor belt can have at least one section with increased reflectivity for the scattered radiation. The reflectivity changes with increasing operating time of the conveyor belt in the folding apparatus. In particular, either a monotonic increase or a monotonic decrease are advantageous.

If the folding apparatus has a number of, or a number of a groups of conveyor belts, the number of conveyor belts can be associated with the monitoring device and the radiation scattered from a conveyor belt can be detected by the monitoring device at least during a period of time.

In order to use only a small number of monitoring devices for a large number of conveyor belts in the folding apparatus according to the present invention, the monitoring device can be movable in the folding apparatus by means of an actuator system.

It is particularly advantageous if the monitoring device of the folding apparatus according to the present invention is connected to the machine control. The information on the quality conditions of the conveyor belt or belts in the folding apparatus can be used for decisions of the machine control. In other words, a program-based machine control carries out control options as a function of the detected presence and/or quality condition of the conveyor belt or belts. For example, the machine can be automatically turned off in case of poor quality of the conveyor belt in order to avoid paper jams or misdirection of paper. Moreover, a poor presence or quality condition can be indicated to the machine operator by a signal via a man-machine interface including, for example, a monitor or a loudspeaker. The signal can be a visible and/or audible signal (light signal and/or signal tone).

The folding apparatus according to the present invention may be usable on web-fed printing presses of all kinds of printing methods, in particular in direct or indirect planographic printing, offset printing, or the like. A folding apparatus according to the present invention can be arranged downstream of a web-fed printing press. Typical printing substrates are paper, cardboard, organic polymer materials, or the like.

BRIEF DESCRIPTION OF THE DRAWINGS

Further advantages as well as expedient embodiments and refinements of the present invention will be depicted by way of the following Figures and the descriptions thereof. Specifically.

DETAILED DESCRIPTION

Figure 1:
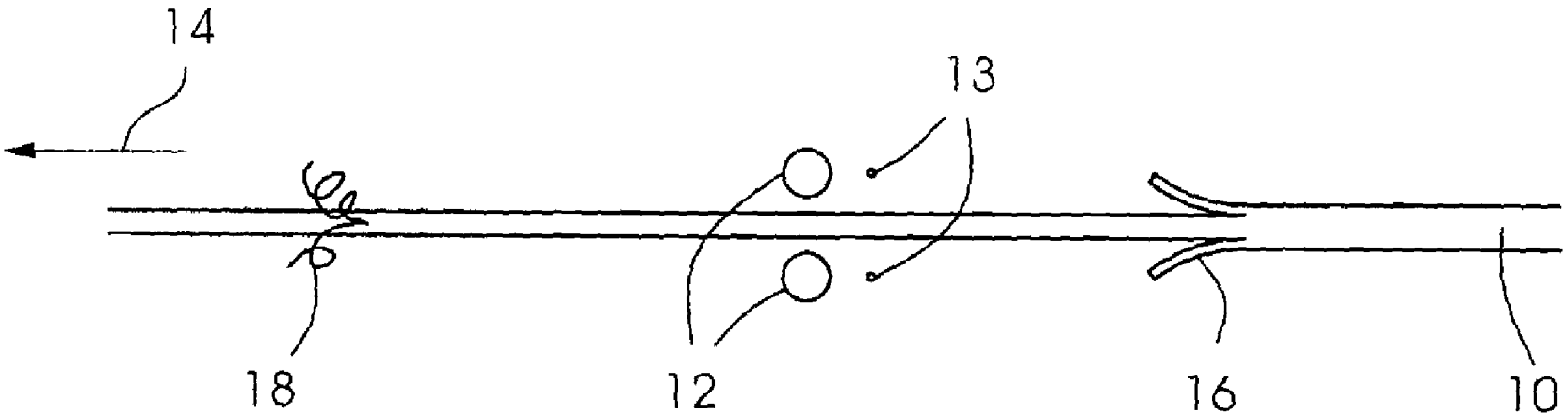
FIG. 1 shows a sketch to illustrate two frequently occurring degradations of conveyor belts in folding apparatuses and the monitoring of these sources of risk of breakage according to the present invention.

FIG. 1 shows a sketch to illustrate two frequently occurring degradations of conveyor belts in folding apparatuses and the monitoring of these sources of risk of breakage according to the present invention. Common conveyor belts for folding apparatuses, whether they are flat or round conveyor belts, have a fabric-like or layered structure. Typically, their paths run straight in some sections, their directions are changed by deflection rollers, and they are under tension along their path. Frequently, provision is made for further elements that are intended to fix the position, that is, the path of the conveyor belts. Both the deflection rollers and the elements for fixing the path can exert frictional forces on the conveyor belts. Conveyor belts are often composed of at least one, originally open belt whose ends are joined and attached together, forming a closed belt. In this context, the connecting point is potentially weaker than other belt sections, which can lead to detachment, for example, because of flexing forces acting during operation due to changes in the moving direction of the tensioned belt. A conveyor belt can also have several connections of that kind.

In FIG. 1, a section of a conveyor belt 10 is shown in a sketchy manner. Conveyor belt 10 is a closed belt alongside of a path which is not further specified here. Provision is made for two monitoring devices 12 whose observing directions 13 run perpendicularly skewed to conveyor belt 10, which moves in direction 14. The axes of observing directions 13, here perpendicular to the plane of paper of FIG. 1, run at an advantageously small distance from the conveyor belt. The exact advantageous distance from the conveyor belt depends on the physical parameters thereof, such as thickness, elasticity, and structure (fabric or layered), and the like. It has turned out that a distance of a few millimeters to several centimeters (2 mm to 2 cm) is advantageous. On the section of conveyor belt 10 shown, a detaching connection 16 is shown. Moreover, conveyor belt 10 has a section of fraying 18. The partially sticking-out ends of detaching connection 16 and the sticking-out, frayed fibers protrude into observing direction 13 of monitoring device 12 during their passage when conveyor belt 10 moves in direction 14. It is especially these degradations of the conveyor belt that are detectable with the aid of monitoring device 12 by detecting radiation that is scattered from the degradations, to be more precise, from the (degraded) parts of conveyor belt 10 that partially protrude into observing direction 13.

Figure 2:
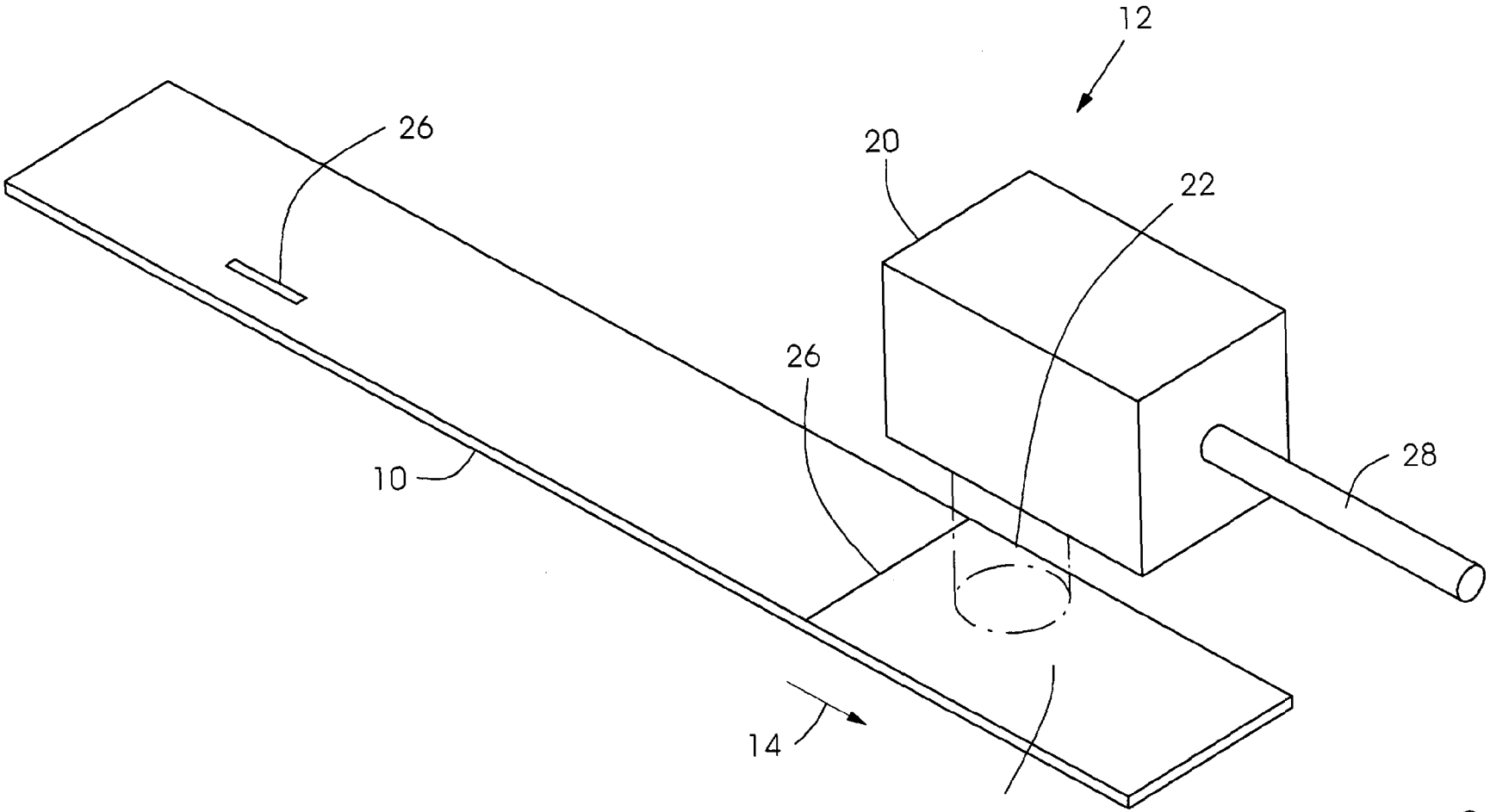
FIG. 2 is a schematic representation to illustrate the monitoring according to the present invention of radiation scattered from at least a part of a conveyor belt, the conveyor belt, by way of example, having sections of increased reflectivity.

FIG. 2 is a schematic representation to illustrate the monitoring according to the present invention of radiation scattered from at least a part of a conveyor belt, the conveyor belt, by way of example, having sections of increased reflectivity.

FIG. 2 shows a further geometry or arrangement for monitoring conveyor belt 10 using a monitoring device 12. Conveyor belt 10 moves past a detector 20 in direction 14. Scattered light 22, preferably visible or infrared light, is measured in detector 20. Radiation 22 is scattered from a part 24 of conveyor belt 10. The detection can be accomplished in two ways during a period of time: on one hand, the detection can be carried out in a timed manner each time a specific section of conveyor belt 10 passes detector 20, on the other hand, radiation 22 that is scattered from a part 24 of conveyor belt 10 is measured only when this part 24 passes detector 20. By way of example, conveyor belt 10 shown in FIG. 2 has two sections 26 with increased reflectivity. The increased reflectivity refers to the radiation wavelengths that are measured by monitoring device 12. In other words, "increased reflectivity" is understood to mean that conveyor belt 10 has a high reflectivity, typically greater than 50%, preferably greater than 80%, at least for a portion of the detected wavelengths whereas the reflectivity for adjacent wavelengths in the spectrum is lower, typically below 50%, preferably below 20%. Increased reflectivity can be achieved by a colored strip or a colored fiber on or in the structure of the conveyor belt. When conveyor belt 10 degrades, i.e., with increasing operating time of conveyor belt 10, then the increased reflectivity changes. This change can be an increase or a decrease: An increase can occur, for example, when a colored inner fiber shows up because outer fibers become frayed. A decrease can occur, for example, when a colored a colored outer layer is removed by abrasion. Monitoring device 12 has a connection 28 to an evaluation unit, which is not shown here in FIG. 2.

Figure 3:
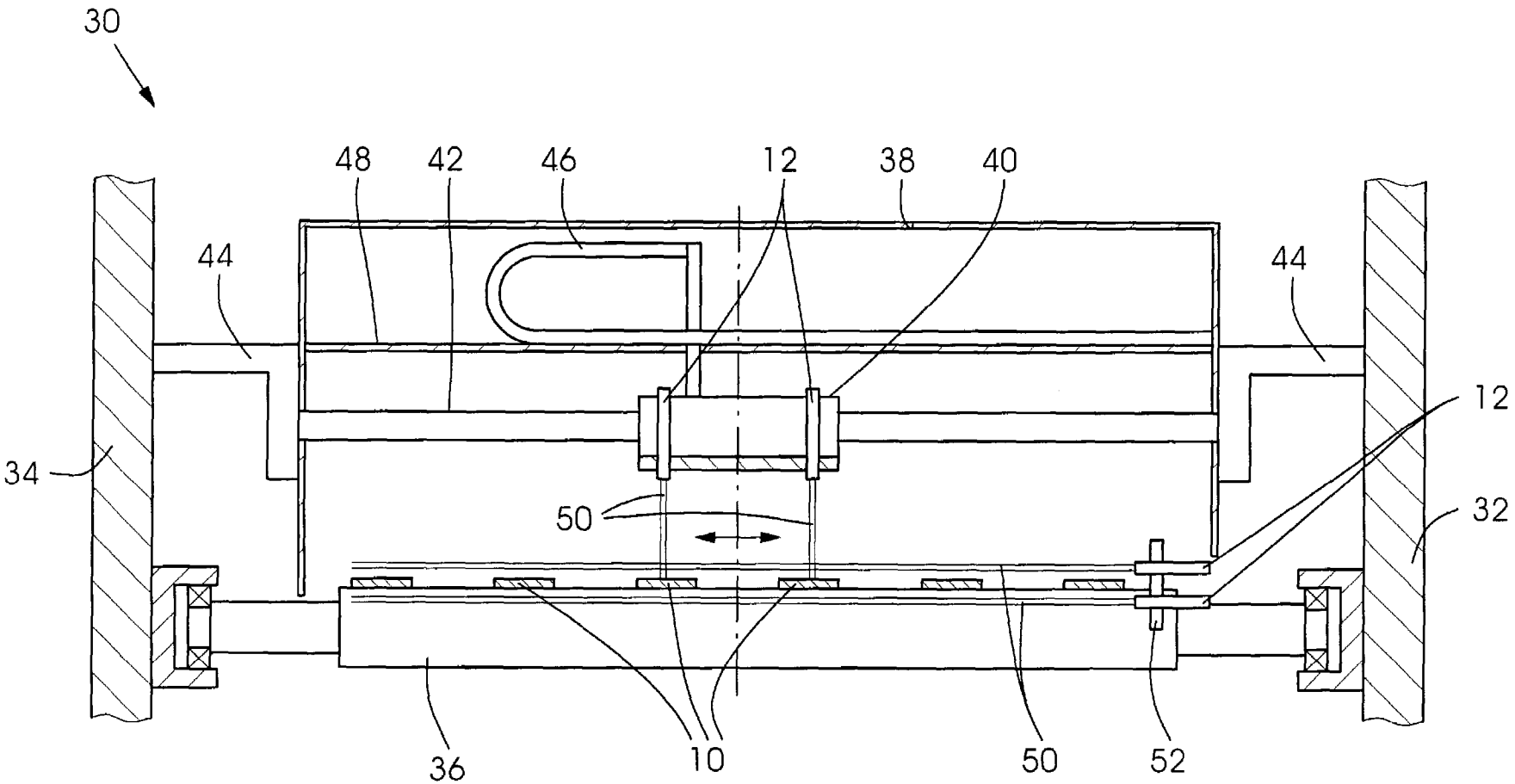
FIG. 3 shows a view of an advantageous embodiment of a monitoring device for conveyor belts in a folding apparatus.

FIG. 3 is a view of an advantageous embodiment of a monitoring device for conveyor belts in a folding apparatus. Folding apparatus 30 has a number of conveyor belts 10 (conveyor belt bank) between side wall 32 of the operating side and side wall 34 of the drive side. Conveyor belts 10 run over a roller 36, which is movably supported at side walls 32, 34. Conveyor belts 10, which are supported by roller 36, run through a chamber 38, which can be at a pressure above atmospheric. Chamber 38 can be used, inter alia, to avoid dirt accumulations on monitoring devices 12.

Two monitoring devices 12 are held on a carriage 40 which, by means of a drive (not further shown here), for example, a servomotor with spindle drive or a linear motor, is movable on a linear guide 42 substantially perpendicular to the running direction of conveyor belts 10. In other words, monitoring devices 12 are movable in folding apparatus 30 by means of an actuator system including carriage 40 and linear guide 42. The linear guide 42 is fixed at the side wall of operating side 32 and the side wall of drive side 34 by holders 44. A connection to monitoring devices 12 is via a trailing cable 46, which is supported by a cross-member 48.

Monitoring devices 12 each include a radiation emitter, here a light emitter, such as a laser, and a radiation detector, here, for example, a photocell. Electromagnetic radiation 50 originating from the light emitters of monitoring devices 12 is at least partially scattered at least at a part of the conveyor belts. These monitoring devices 12 can be used to detect the presence condition of conveyor belts 10. It is particularly advantageous and therefore preferred to use laser radiation, in particular because of its directionality, its spectral power density and low total power requirement. The radiation emitter and the radiation detector can be combined in the form of a triangulation sensor.

FIG. 3 also shows two monitoring devices 12 that are supported by a holding member 52. These monitoring devices 12 feature radiation emitters and radiation detectors. Electromagnetic radiation 50 originates from the light emitters of monitoring device 12 and travels past conveyor belts 10, skewed to the direction of conveyor belts 10. In this embodiment, electromagnetic radiation 50 propagates substantially perpendicular to conveyor belts 10 and has a substantially constant distance from conveyor belts 10. Using monitoring devices 12, detaching connections or fraying (see FIG. 1) can be detected particularly well. These monitoring devices 12 can be used, in particular, to detect the quality condition of conveyor belts 10. The use of laser radiation is particularly advantageous and therefore preferred for these monitoring devices 12 as well. The radiation emitters and the radiation detectors of these monitoring devices 12 can be combined in the form of triangulation sensors.

Figure 4:
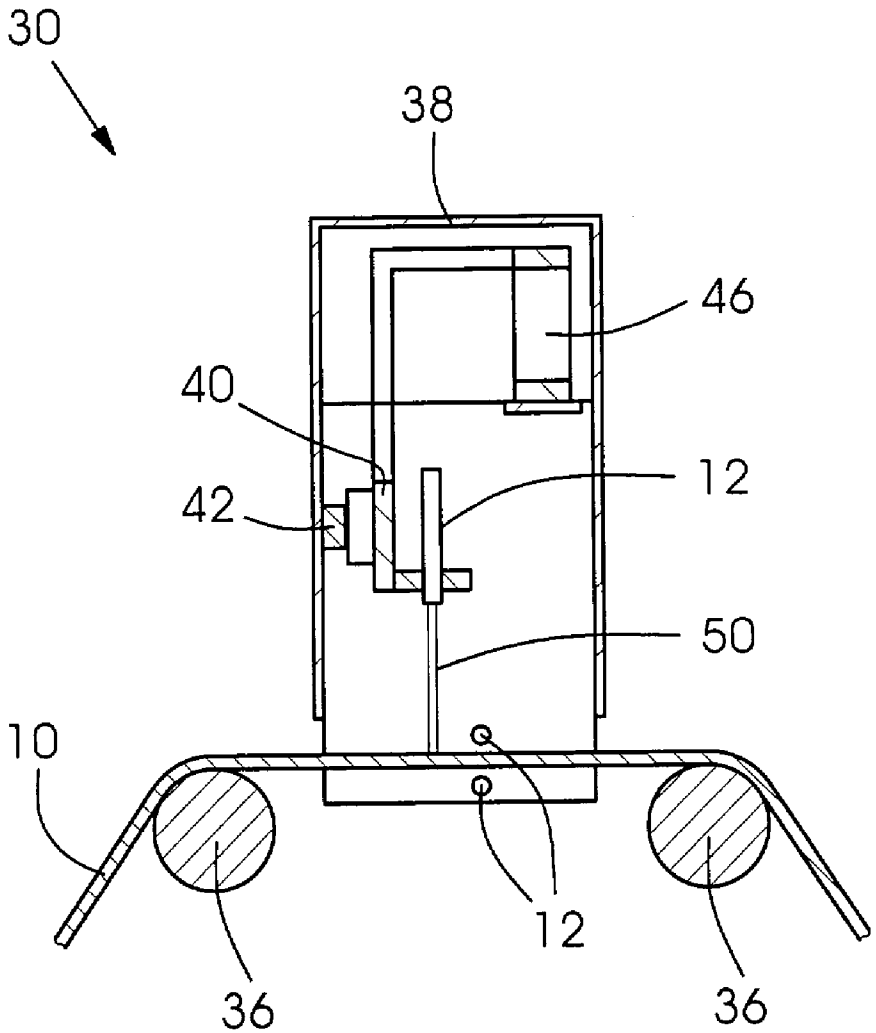
FIG. 4 is a lateral view of an advantageous embodiment of a monitoring device for conveyor belts in a folding apparatus.

FIG. 4 is a lateral view of an advantageous embodiment of a monitoring device 12 for conveyor belts 10 in a folding apparatus 30. There is shown a section of a conveyor belt 10 which runs over rollers 36 and passes through a chamber 38. A monitoring device 12, which is able to emit and detect electromagnetic radiation 50, is located on a carriage 40, which is movable relative to conveyor belt 10 substantially perpendicular to its moving direction 14 with the aid of a linear guide 42. Monitoring device 12 has a connection 28 to an evaluation unit (not further shown here) via a trailing cable 46. Also shown are the monitoring devices 12 whose observing direction 13 (See FIG. 1) runs skewed in a substantially perpendicular manner to conveyor belt 10 (in the representation of FIG. 4 perpendicular to the plane of paper).

Figure 5:
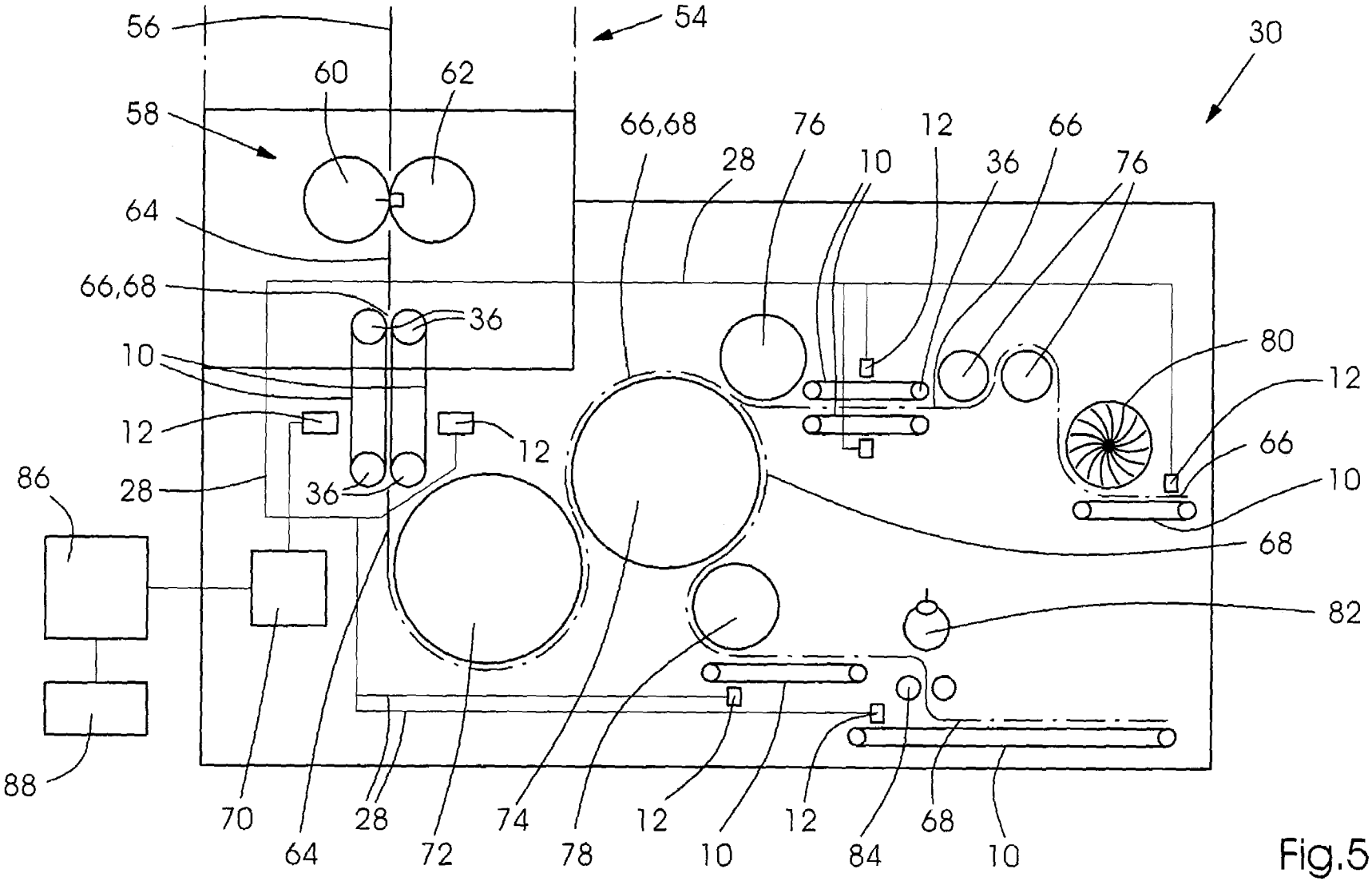
FIG. 5 is a schematic representation of an embodiment of a folding apparatus according to the present invention, including a number of conveyor belts with which are associated monitoring devices.

FIG. 5 is a schematic representation of an embodiment of a folding apparatus according to the present invention including a number of conveyor belts with which are associated monitoring devices. Conveyor belts 10 convey signatures 64 through folding apparatus 30 at least on a section of a path. A folding apparatus 30, which features an only exemplary configuration of different paths of signatures 64 and different processing devices, is arranged downstream of a web-fed printing press 54. Printing-material web 56 initially passes a cross cutter 58 which includes a cutting cylinder 60 and a grooved cylinder 62 and in which signatures 64 are cut off from printing-material web 56. Below cutting cylinder 60 and grooved cylinder 62, there are shown conveyor belts 10 which run around rollers 36 and between which runs first path 66 and second path 68 through folding apparatus 30. Monitoring devices 12 are associated with conveyor belts 10 as described above in greater detail. First path 66 and second path 68, along which signatures 64 move through folding apparatus 30, run around a folding blade cylinder 72 to a folding jaw cylinder 74. After that, the paths diverge. First path 66 runs along a transport cylinder 76 between two conveyor belts 10, which run around rollers 36. These conveyor belts also have associated therewith monitoring devices 12. Path 66 runs on over further transport cylinders 76 and a fan delivery to a conveyor belt 10 with which is associated a monitoring device 12. Second path 68 runs over a gripper cylinder to a conveyor belt 10 with an associated monitoring device 12. From there, path 68 runs below a rotary knife folding unit 82 which pushes signatures 64 through the gap formed by the two folding rollers 84. Signatures 64 reach a further conveyor belt 10 with an associated monitoring device 12.

Monitoring devices 12 can be designed according to the embodiments shown in FIGS. 3 and 4. Monitoring devices 12 have connections 28 to an evaluation unit 70 including a computing device. In evaluation unit 70, the signals that are generated in monitoring devices 12 and which are representative of the condition of the respectively associated conveyor belts 10 can be correlated to predetermined values, for example, in the form of a nominal/actual value comparison with reference data stored in a memory, and thus be classified in condition classes (presence condition and/or quality condition). In the embodiment of folding apparatus 30 according to the present invention shown in FIG. 5, evaluation unit 70 is in communication with machine control 86 so that specific measures for controlling the machine, such as shutdown or signaling, can be carried out depending on the result of the condition class assignment. Moreover, machine control 86 has a connection to a man-machine interface 88, which typically has a display unit (such as a monitor), an input unit (such as a keyboard, a touch screen, a switch area, or the like), a visual or audible signaling unit, and the like. Via man-machine interface 88, the machine operator can be informed of the condition of conveyor belts 10 in folding apparatus 30, which will allow the machine operator to take appropriate measures, for example, to replace one or more of conveyor belts 10.

LIST OF REFERENCE NUMERALS

10 conveyor belt
12 monitoring device
13 observing direction
14 moving direction
16 detaching connection
18 fraying
20 detector
22 scattered radiation
24 part of the conveyor belt
26 section with increased reflectivity
28 connection to the evaluation unit
30 folding apparatus
32 side wall of the operating side
34 side wall of the drive side
36 roller
38 chamber
40 carriage
42 linear guide
44 holder
46 trailing cable
48 cross-member
50 electromagnetic radiation
52 holding member
54 web-fed printing press
56 printing-material web
58 cross cutter
60 cutting cylinder
62 grooved cylinder
64 signature
66 first path through the folding apparatus
68 second path through the folding apparatus
70 evaluation unit
72 folding blade cylinder
74 folding jaw cylinder
76 transport cylinder
78 gripper cylinder
80 fan delivery
82 rotary knife folding unit
84 folding rollers
86 machine control
88 man-machine interface

What is claimed is:

1. A folding apparatus comprising:

at least one conveyor belt for conveying signatures at least on a section of a path of the signatures through the folding apparatus, and at least one monitoring device associated with the conveyor belt, the monitoring device including a detector for radiation scattered from at least a part of the conveyor belt during at least a period of time;

wherein the conveyor belt has at least one section with increased reflectivity for the radiation, the reflectivity changing with increasing operating time of the conveyor belt in the folding apparatus.

2. The folding apparatus as recited in claim 1 wherein the increased reflectivity section changes reflectivity in a monotonically increasing or a monotonically decreasing manner.

3. The folding apparatus as recited in claim 1 wherein the radiation is electromagnetic radiation or ultrasound.

4. The folding apparatus as recited in claim 1 wherein the monitoring device further includes a radiation emitter.

5. The folding apparatus as recited in claim 1 wherein the at least one conveying belt includes a plurality of conveyor belts, the plurality of conveyor belts being associated with the monitoring device and the radiation scattered from one of the plurality of conveyor belts being detected by the monitoring device at least during a period of time.

6. The folding apparatus as recited in claim 5 further comprising an actuator system for moving the monitoring device.

7. The folding apparatus as recited in claim 1 further comprising a machine control connected to the monitoring device.

8. The folding apparatus as recited in claim 1 wherein the monitoring device is located entirely on a first side of the belt.

9. The folding apparatus as recited in claim 1 wherein the monitoring device is capable of monitoring a partial fraying of the conveyor belt.

10. A web-fed printing press comprising:

at least one downstream folding apparatus having at least one conveyor belt for conveying signatures at least on a section of a path of the signatures through the folding apparatus, and at least one monitoring device associated with the conveyor belt, the monitoring device including a detector receiving radiation scattered from at least a part of the conveyor belt during at least a period of time, wherein the conveyor belt has at least one section with increased reflectivity for the radiation, the reflectivity changing with increasing operating time of the conveyor belt in the at least one downstream folding apparatus.

11. A method for monitoring at least one conveyor belt in a folding apparatus comprising the steps of:

receiving radiation scattered from at least a part of the conveyor belt at least during a period of time wherein the conveyor belt has at least one section with increased reflectivity for the radiation, the reflectivity changing with increasing operating time of the conveyor belt in the folding apparatus;

generating a signal representative of a condition of the conveyor belt; and assigning the signal to a condition class.

12. The method as recited in claim 11 further comprising emitting the radiation past the conveyor belt skewed to the direction of the conveyor belt.

13. The method as recited in claim 11 wherein partial fraying on a side of the conveyor belt is monitored.

14. The method as recited in claim 11 wherein a first monitor monitors one side of the conveyor belt and a second monitor monitors an other side of the conveyor belt.

15. The folding apparatus as recited in claim 13 further comprising a second monitoring device for monitoring a second side of the belt.

* * * * *